United States Patent [19]

Lucius et al.

[11] 3,989,343

[45] Nov. 2, 1976

[54] MEANS FOR MOUNTING AN ELECTRICAL CONNECTOR IN A PANEL OPENING FROM EITHER SIDE OF THE PANEL

[75] Inventors: John Edward Lucius, Harrisburg; Linn Stephen Lightner, Camp Hill, both of Pa.

[73] Assignee: AMP Incorporated, Harrisburg, Pa.

[22] Filed: Jan. 27, 1976

[21] Appl. No.: 652,675

[52] U.S. Cl. ..... 339/128; 248/27.3; 339/126 R

[51] Int. Cl.[2] ..... H01R 9/16

[58] Field of Search ..... 339/125 R, 126 R, 128, 339/91 R, 75 R, 75 M, 176 R, 176 P; 248/17 A, 27

[56] References Cited

UNITED STATES PATENTS

| | | | |
|---|---|---|---|
| 3,573,716 | 4/1971 | Garver | 339/128 |
| 3,790,923 | 2/1974 | Mathe | 339/128 |
| 3,794,278 | 2/1974 | Frey et al. | 248/27 A |

*Primary Examiner*—Roy Lake
*Assistant Examiner*—E. F. Desmond
*Attorney, Agent, or Firm*—Russell J. Egan

[57] ABSTRACT

An improved mounting means is disclosed for removably mounting electrical connectors and the like in openings in a panel with the mounting and dismounting taking place from either side of the panel. The mounting means can compensate for various thickness panels as well as for variations in the thickness of a panel.

3 Claims, 3 Drawing Figures

MEANS FOR MOUNTING AN ELECTRICAL CONNECTOR IN A PANEL OPENING FROM EITHER SIDE OF THE PANEL

BACKGROUND OF THE INVENTION

1. The Field Of The Invention

The present invention relates to an improved mounting means for locking an electrical connector or the like in an aperture in a panel and in particular for a mounting means which allows the connector to be inserted or removed from either side of the panel.

2. The Prior Art

There are many times when it is desirable to fix one component of an electrical connector in an aperture in a panel or the like. Examples of such devices can be found in U.S. Pat. Nos. 3,569,909, and 3,573,716. Both of these patents show panel mounting means generally defined by a channel-like member supported on a first side by a single leg and on a second side by a pair of legs. All of the legs are flexible. to a limited extent, thus allowing the connector to be inserted into a profile aperture in the panel and locked therein. Such mounting means have a disadvantage in not being readily releasable from either side of the panel and, frequently, they can not compensate for variances in paneled thickness or even be used with panels of different thicknesses.

SUMMARY OF THE INVENTION

The present invention comprises means for mounting an electrical connector or the like in an opening in a panel and which allows the connector to be inserted into and removed from the opening from either side of the panel. The subject mounting means positively locks the connector in place in panels of different thicknesses or with variations in thickness. The mounting means comprises, on each of two opposite sides of the connector, at least three interdigitated cantilever beams each having an outwardly directed step. The nose and tail portions of adjacent beams overlap so that the steps together define an overall channel-like panel engaging portion. The beams are deflected by pushing on the nose and tail portions of adjacent beams, the beams having sufficient deflection to move their respective steps to such position as will allow withdrawal of the connector from the aperture.

It is therefore an object of the present invention to produce an improved means for mounting electrical connectors and the like which allows the connector to be inserted into and/or withdrawn from either side of the panel.

It is another object of the present invention to produce an improved mounting means which enables the mounting of an electrical connector and the like in panels of different thicknesses without changing the locking device.

It is still another object of the present invention to produce an improved mounting means which will compensate for variations in the thickness of a panel.

It is a further object of the present invention to produce an improved mounting means which can be readily and economically produced.

The foregoing objects and other advantages of the present invention will be made clear to those skilled in the art from the following detailed discussion taken with reference to the accompanying drawings.

DETAILED DESCRIPTION OF THE PREFERRED EMBODIMENT

Figure 1:
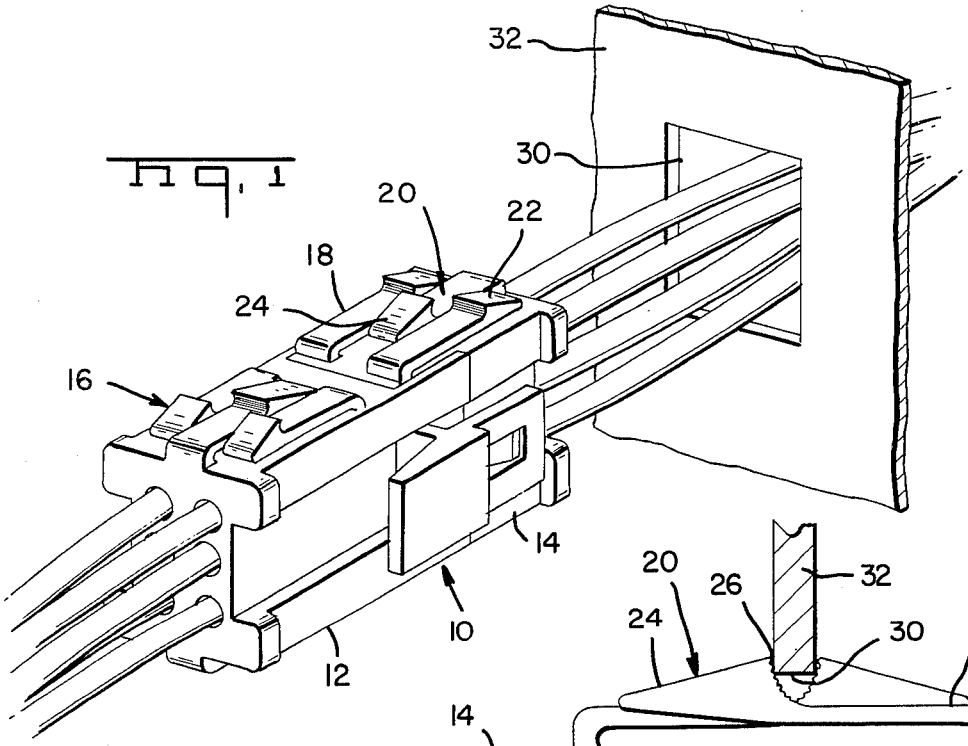
FIG. 1 is a perspective view of an assembled electrical connector, incorporating the subject panel mounting means, exploded from a profiled panel aperture adapted to receive the connector.

The subject locking device has been shown in combination with an electrical connector of known type. The electrical connector 10 includes mating plug 12 and receptacle 14 members each of which is provided with the subject panel mounting means generally noted by reference numeral 16. The mounting means 16 comprises, on each of two opposite sides of each connector member, at least three interdigitated cantilever beam arms 18, 20, 22 arranged to extend in opposite directions in an overlapping configuration. The beams each have a profiled free end portion 24, a serrated outwardly directed step 26, and a resilient tail portion 28 integral with the respective connector member.

The connector is shown in FIG. 1 ready to be inserted into a profiled aperture 30 in a panel 32. The connector can be inserted into the aperture simply by moving the connector normal to the panel and pushing it into place. The profiled free ends of the beams will be cammed downwardly by the walls of the aperture until the steps 26 clear the panel and are released to snap up on the opposite side of the panel. The connector member can also be inserted into or removed from the panel by depressing all the beams simultaneously be pressing against the nose and tail portions of adjacent beams in the directions noted by arrow 34 and moving the connector member in either direction noted by the double arrow 36. The double arrow also denotes that the connector member can be inserted and/or removed from either side of the panel 32.

Figure 2:
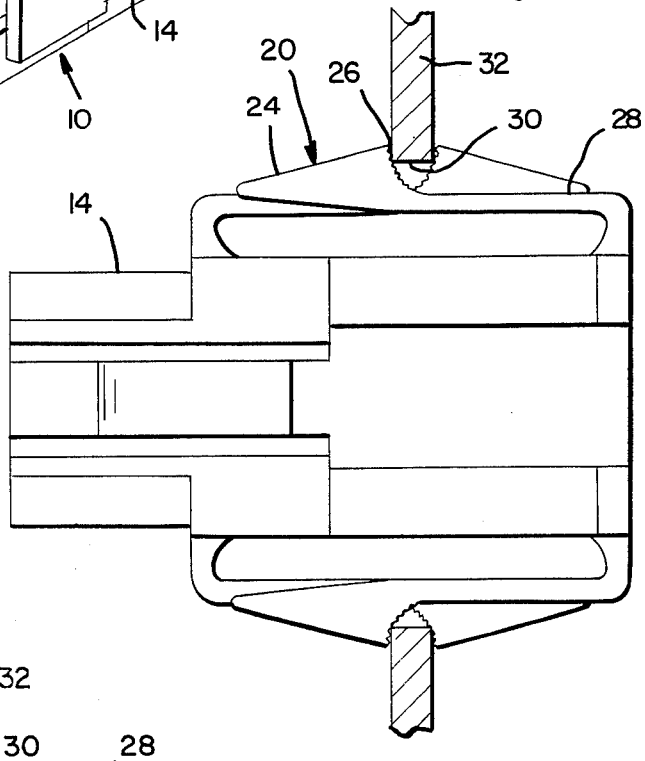
FIG. 2 is a vertical section through the panel of FIG. 1 showing the connector mounted therein.
Figure 3:
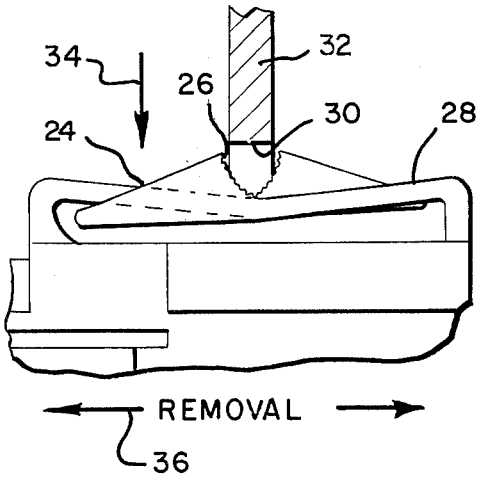
FIG. 3 is a partial view, similar to FIG. 2, showing the locking device depressed for removal from the panel.

It can be seen from FIG. 2 that, because of the serrated configuration of the steps 26, the beams will accommodate therein panels of different thicknesses and/or panels with variations of thickness. It will also be noted that, because the mounting means is arranged on opposite sides of the connector, the connector will be stabilized in a substantially central location within the aperture 30. The panel mounted connector member will also withstand substantial forces related to mating and unmating with the other connector member without being pushed or pulled from the panel aperture.

The connector and mounting means of the present invention can preferably be molded from a single material, such as glass reinforced thermoplastic. Other materials can, of course, be substituted so long as they have the requisite resiliency for flexing of the beams for the insertion and extraction of the connector member in the panel aperture.

The present invention may be subject to many modifications and changes without departing from the spirit or essential characteristics thereof. The present embodiment is therefore to be considered in all respects as illustrative and not restrictive of the scope of the invention.

What is claimed is:

1. In combination with an electrical connector assembly comprising first and second connector members, each being matable with the other to thereby engage contact terminals mounted therein with each other, one of said members comprising a plug member having a mating face and the other said member being a receptacle member having a hooded face receiving said first member therein, mounting means on two opposite sides of each of said members whereby either of said members can be selectively detachably mounted in a profile panel opening, said mounting means comprising at least three interdigitated, cantilever beam members on each of said opposite sides of said connector members, said beams being interleaved with each other from opposite directions and overlapping the length, each beam having a tail portion integral with said member, a profiled nose at the free end thereof and an outwardly directed profiled step intermediate said nose and said tail, said step of adjacent arms defining therebetween a panel engaging channel extending normal to the axes of said arms.

2. A connector assembly according to claim 1 wherein said profiled step on each said beam comprises a series of parallel striations extending normal to the axis of said arm whereby gripping panels of different thicknesses is accomplished.

3. Mounting means for detachably securing a member within a profiled aperture in a panel, said mounting means comprising:

at least three interdigitated cantilever beam arms on each of two opposite sides of said member, each said cantilever arm having a tail portion integral with said member, a profiled nose on the free end thereof, and an outwardly directed profiled step intermediate the ends of said arm, adjacent arms extending in opposite directions with said profiled steps in overlapping arrangement defining therebetween a channel-like area extending normal to the axes of said arms, whereby said member is mounted in and removed from said aperture from either side of the panel by pushing the arms to a deflected position, inserting the member into the aperture and releasing the arms to grip the panel between the profiled step portions thereof.

* * * * *